US006257509B1

(12) United States Patent
Hafner et al.

(10) Patent No.: US 6,257,509 B1
(45) Date of Patent: Jul. 10, 2001

(54) FUEL INJECTOR

(75) Inventors: Udo Hafner, Ludwigsburg; Klaus Noller, Oppenweiler; Heinz Fuchs, Stuttgart; Albert Staacke, Steinheim, all of (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/486,044

(22) PCT Filed: Apr. 12, 1999

(86) PCT No.: PCT/DE99/01075

§ 371 Date: May 15, 2000

§ 102(e) Date: May 15, 2000

(87) PCT Pub. No.: WO99/66195

PCT Pub. Date: Dec. 23, 1999

(30) Foreign Application Priority Data

Jun. 18, 1998 (DE) ..... 198 27 136

(51) Int. Cl.[7] ..... B05B 1/30; F02M 51/00

(52) U.S. Cl. ..... 239/585.1; 239/585.2; 239/585.3; 239/585.4; 239/585.5; 239/900; 251/129.16; 251/129.21

(58) Field of Search ..... 239/585.1, 585.2, 239/585.3, 585.4, 585.5, 900; 251/129.16, 129.21

(56) References Cited

U.S. PATENT DOCUMENTS

| | | | | |
|---|---|---|---|---|
| 3,913,537 | | 10/1975 | Ziesche et al. . | |
| 4,946,107 | * | 8/1990 | Hunt | 239/585.1 |
| 4,957,241 | * | 9/1990 | Roger | 239/585.1 X |
| 4,959,027 | | 9/1990 | Muzslay . | |
| 5,044,563 | | 9/1991 | Mesenich . | |
| 5,156,124 | | 10/1992 | Tomojiro et al. . | |
| 5,275,341 | * | 1/1994 | Romann et al. | 239/585.4 |
| 5,758,826 | * | 6/1998 | Nines | 239/585.1 X |
| 6,012,655 | * | 1/2000 | Maier | 239/585.4 |
| 6,027,049 | * | 2/2000 | Stier | 239/585.1 |

FOREIGN PATENT DOCUMENTS

| | | |
|---|---|---|
| 34 39 672 | 4/1986 | (DE) . |
| 196 31280 | 2/1998 | (DE) . |
| 197 12 591 | 10/1998 | (DE) . |

* cited by examiner

*Primary Examiner*—David A. Scherbel
*Assistant Examiner*—Robin O. Evans
(74) *Attorney, Agent, or Firm*—Kenyon & Kenyon

(57) ABSTRACT

A fuel injector for fuel injection systems of internal combustion engines, which is composed of two preassembled, independent subassemblies. In this context, a functional part essentially includes an electromagnetic circuit and a sealing valve, whereas a connecting part is essentially constituted of a hydraulic connection. In the ready-assembled injector, electrical connecting elements and hydraulic connecting elements of both subassemblies cooperate so that a reliable electrical and hydraulic connection is ensured. The valve is executed as a side-feed injector, and the electrical connection is located farther away from functional part than the hydraulic connection of the connecting part. The fuel injector is particularly suitable for use in fuel injection systems of mixture-compressing, positive ignition internal combustion engines.

13 Claims, 6 Drawing Sheets

57
56
79
72
10
40
44
44
73
42
58
43
50
51
59
47
60
46
34
33
29
2
28
3
11
1
17
30
32
5
12
23
22
6
25
14
18
19
16
24
13
15
20
27
21

FUEL INJECTOR

BACKGROUND INFORMATION

The present invention relates to a fuel injector.

U.S. Pat. No. 5,156,124 already describes a fuel injector, which can be actuated electromagnetically. To that end, the fuel injector has the usual component parts of an electromagnetic circuit, such as a magnetic coil, an internal pole, and an external pole. This known injector is a so-called "side-feed injector", where the fuel supply takes place substantially underneath the magnetic circuit. Contact pins originating at the magnetic coil protrude from the fuel injector, which are injection-molded around with plastic over a certain length and are embedded in this. The plastic injection molding is applied at one end of the fuel injector and does not constitute an independent component part of the fuel injector.

The same applies to the fuel injector known from German Patent No. 34 39 672. Here also, contact pins originating at the magnetic coil protrude toward an electric attachment plug which is formed of plastic and partially surrounds the contact pins behind the magnetic coil. In this context, the plastic injection molding forming the attachment plug is injection molded on the metallic valve housing.

In German Published Patent Application No. 197 12 591, it was already proposed to assemble a fuel injector of two preassembled subassemblies, a functional part and a connecting part, which are produced and adjusted separately, and are subsequently fixedly interconnected. By connecting the two subassemblies, an electrical and a hydraulic connection is provided as well. The joining of the two subassemblies is carried out with the assistance of ultrasonic welding, bonding, or crimping.

SUMMARY OF THE INVENTION

The fuel injector according to the present invention has the advantage that it can be manufactured in a simple and inexpensive manner, and mounted securely and reliably. Furthermore, according to the present invention, a particularly compact design is achieved for the fuel injector. In addition, it is an advantage that a great mechanical stability of the fuel injector is achieved. Furthermore, it is guaranteed that the electrical connecting elements are safe and protected inside the injector.

Moreover, the designs of the fuel injector can be varied very easily. This is achieved in that two subassemblies of the fuel injector, a functional part and a connecting part, are preassembled or adjusted separately from each other. In this context, the functional part includes an electromagnetic circuit and a seating valve made up of valve-seat body and valve-closure member. On the other hand, the electrical and the hydraulic connections of the fuel injector are provided in the connecting part. All described exemplary embodiments of the fuel injectors have the advantage of an inexpensive producibility, including a great number of design variants, Functional parts, which are manufactured in great quantities, largely of the same design (differences, e.g., in the magnitude of the valve needle lift or in the number of turns per unit of length of the magnetic coil), can be connected to a great number of different connecting parts differing, for example, in the size and form design, in the design of the electric attachment plug, and the fasteners for the installation in a receiving socket or on a fuel distributor, in the construction of the lower end face of the connecting part, or also with regard to their color, their marking, their lettering, or another identification. Thus, the logistics during the manufacture of fuel injectors is fundamentally simplified.

Due to the separation into two subassemblies, the advantage ensues that all negative influences during the manufacture of the connecting part, which is substantially made of plastic (high injection molding pressures, development of heat) are kept away from the components parts of the functional part which perform the important valve functions. The relatively dirty injection molding process can advantageously be carried out outside of the assembly line of the functional part.

Because the fuel injector is designed as so-called "side-feed injector", the advantage of laterally integrating a supply duct at an induction pipe or immediately at the cylinder head of an internal combustion engine ensues so that additional fuel distributors and complex connectors can be dispensed with.

As a general principle, such a valve type offers itself to be mounted directly on the cylinder head, and therefore to be used, for example, as an injector for injecting a fuel directly into a combustion chamber.

For producing a fixed connection of the two subassemblies, it is particularly advantageous to select a plastic for the injection molding which has its melting point at a higher temperature as the plastic used for the connecting part. Thus, it is guaranteed that a polymeric compound is formed between the two plastics. It is an advantage to execute a labyrinth seal at the outer circumference of the connecting part. In this manner, during the injection molding, a heat distribution is achieved which makes a good melting on possible. Moreover, it is achieved that a high mechanical stability in this region and, consequently, of the entire fuel injector, as well as a good tightness are guaranteed.

It is beneficial for the functional part performing all important valve functions to have very short design. Thus, a simplified access to the component parts of the fuel injectors which are to be adjusted results in an advantageous manner. Resulting primarily are markedly shortened paths for the mounting of measuring arrangements such as probes for measuring the lift of the valve needle or tools for adjusting the dynamic spray quantity at the adjusting element.

In an advantageous manner, it is possible to make a very substantial variation of the electrical connecting elements at the functional part and the connecting part. Thus, it is always possible to execute the electrical connecting elements both at the functional part and at the connecting part in a form which is either similar to that of a plug or of a bushing, or as a combination of both ways.

DETAILED DESCRIPTION

Figure 1:
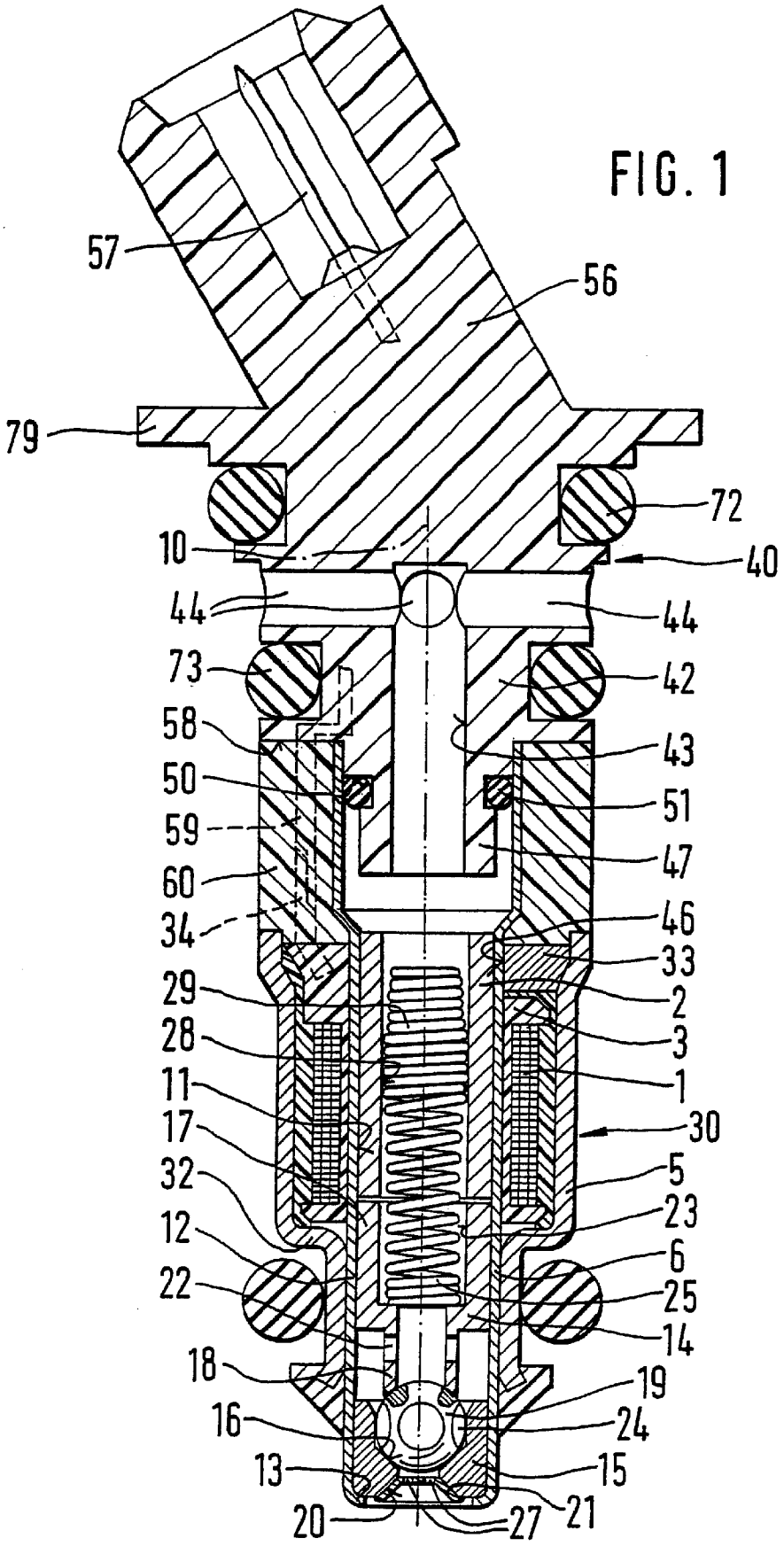
FIG. 1 shows a first fuel injector according to the present invention formed as a "side-feed injector" having two independently preassembled subassemblies in the assembled condition.

The valve according to the present invention in the form of a side-feed injector for fuel-injection systems of mixture-compressing, positive ignition internal combustion engines, which is able to be actuated electromagnetically and depicted in FIG. 1 in an exemplary and partially simplified manner, has a substantially tubular core 2, which is surrounded by a magnetic coil 1, and which serves as an internal pole and partially as fuel passage. Magnetic coil 1 is surrounded, as an external pole, by an external, for example, ferromagnetic valve jacket which is sleeve-shaped and executed in a stepped manner, and which completely surrounds magnetic coil 1 in the circumferential direction. Magnetic coil 1, internal pole 2, and external pole 5 jointly form an electrically excitable actuating element. In a further embodiment variant (not shown), the actuating element can perfectly be executed as piezoelectric actuator as well.

While magnetic coil 1, which is embedded in a coil shell 3, surrounds a valve sleeve 6 on the outside, core 2 is mounted in an internal opening 11 of valve sleeve 6, opening 11 running concentrically to a valve axis 10. The, for example, ferritic valve sleeve 6 is designed in an elongated and thin-walled manner, and has a jacket section 12 and a bottom section 13, opening 11, at its downstream end, being limited by jacket section 12 in the circumferential direction and bottom section 13 in the axial direction. Opening 11 is also used as guide opening for a valve needle 14 which is axially movable along valve axis 10.

Furthermore, besides core 2 and valve needle 14, a valve-seat body 15 is arranged in opening 11, the valve-seat body seating, for example, on bottom section 13 of valve sleeve 6 and having a fixed valve-seat face 16 as valve seat. Valve needle 14 is formed, for example, by a tubular armature section 17, an also tubular needle section 18, and a spherical valve-closure member 19, valve-closure member 19 being fixedly connected to needle section 18, for example, with the assistance of a weld. At the downstream end face of valve-seat body 15, a flat spray-orifice plate 21 is arranged, for example, in a frustoconically running depression 20, the fixed connection of valve-seat body 15 and spray-orifice plate 21 being achieved, for example, by a continuous tight weld. In needle section 18 of valve needle 14, provision is made for one or a plurality of cross openings 22 so that fuel flowing through armature section 17 in an internal longitudinal bore hole 23 can issue and flow at valve-closure member 19, for example, along flattenings 24 up to valve-seat face 16.

The injector is actuated in known manner, here, for example, electromagnetically. However, an actuation with the assistance of a piezoelectric actuator is conceivable as well. The electromagnetic circuit including magnetic coil 1, internal core 2, external valve jacket 5, and armature section 17, is used to axially move valve needle 14, and, consequently, to open against the spring resilience of a return spring 25 acting upon valve needle 14 or to close the injector. Armature section 17, with the end facing away from valve-closure member 19, is aligned toward core 2.

Spherical valve-closure member 19 cooperates with valve-seat face 16 of valve-seat body 15, valve-seat face 16 being formed in valve-seat body 15 in the axial direction downstream of a guide opening and frustoconically tapering in the direction of flow. Spray-orifice plate 21 has at least one, for example, four spray orifices 27 formed by erosive machining, laser boring, or punching.

The insertion depth of core 2 in the injector is decisive, inter alia, for the lift of valve needle 14. In this context, when magnetic coil 1 is not excited, one end position of valve needle 14 is defined by the contact of valve-closure member 19 with valve-seat face 16 of valve-seat body 15, whereas the other end position of valve needle 14, while magnetic coil 1 is excited, results from the contact of armature section 17 with the downstream core end. The lift is adjusted by axially displacing core 2, which is subsequently fixedly connected to valve sleeve 6 according to the desired position.

Besides return spring 25, an adjusting element in the form of an adjusting spring 29 is inserted in a flow hole 28 of core 2, which runs concentrically to valve axis 10, and is used for supplying fuel in the direction of valve-seat face 16. Adjusting spring 29 is used to adjust the spring bias of the return spring 25 which engages on adjusting spring 29, and which, on the other hand, is braced against valve needle 14 with its opposite end, an adjustment of the dynamic spray quantity being carried out with the assistance of adjusting spring 29 as well. Instead of an adjusting spring, the adjusting element can also be executed as adjusting pin, adjusting sleeve, etc.

The injector described up to this point, stands out because of its particularly compact design, thus resulting in a very small, handy injector. These component parts form a preassembled independent subassembly, which, in the following, is referred to as functional part 30, and is separately shown again in FIG. 3 as such a subassembly. Thus, functional part 30 includes electromagnetic circuit 1, 2, 5, as well as a sealing valve (valve-closure member 19, valve-seat body 15) having a subsequent jet preparation element (spray-orifice plate 21).

The coil space which is formed between valve jacket 5 and valve sleeve 6, and is nearly completely filled by magnetic coil 1, is limited by a stepped radial region 32 in the direction toward valve-seat body 15, while the closure on the end facing away from valve-seat body 15 is guaranteed by a disk-shaped cover element 33. In an opening of cover element 33, this is protruded through by coil shell 3. In this region, for example, two contact pins or bushings 34 protrude from the plastic of coil shell 3, and consequently from functional part 30. The electrical contacting of magnetic coil 1, and thereby its excitation, is carried out via electrical contact pins or bushings 34, which are used as electrical connecting elements.

Completely independently of functional part 30, a second subassembly is manufactured, which, in the following, is referred to as connecting part 40. Independent and preassembled connecting part 40 is depicted, assembled with functional part 30 as part of the entire injector, in FIG. 1, as well as independently separately in FIG. 2, the section through connecting part 40 being led such that it is rotated by 90° compared to FIG. 1. Connecting part 40 stands out primarily in that it includes the electrical and the hydraulic connections of the fuel injector. Connecting part 40, which is largely executed as plastic part, has a base member 42 serving as fuel passage. A flow hole 43 running in base member 42 concentrically to valve axis 10 is fed at the inflow end by at least one, for example, four radial boreholes 44. Radial boreholes 44 begin at the outer circumference of base member 42, which is why this fuel supply and flow guidance can be referred to as side-feed supply.

In the completely assembled fuel injector, a hydraulic connection of connecting part 40 and functional part 30 is achieved by bringing flow holes 43 and 28 of the two subassemblies relative to each other in such a manner that an unhindered flow of the fuel is guaranteed. An internal opening 46 in cover element 33 allows valve sleeve 6, and consequently also core 2, to be designed in such a manner that both protrude through opening 46, and at least valve sleeve 6 markedly projects over cover element 33 in the direction of connecting part 40. When mounting connecting part 40 on functional part 30, a lower end region 47 of base member 42 can protrude into the projecting part of valve sleeve 6 in opening 11 of valve sleeve 6 to increase the connecting stability.

End region 47 of connecting part 40 is executed, for example, in a stepped manner, base member 42 being greatly thinned at a lower end face 58 in terms of outside diameter. Thinned end region 47 is provided with an annular groove 50 in which a sealing element, for example, an O-shaped sealing ring 51 is arranged. Thus, a sufficient sealing is guaranteed in the interconnection region of both subassemblies 30 and 40.

Besides the actual base member 42, an integrally injection-molded electrical attachment plug 56 belongs to connecting part 40 as well, and follows immediately on the side of radial boreholes 44 facing away from functional part 30. Provided in connecting part 40 are further two electrical contact elements which, during the plastic injection molding process of connecting part 40, are injection molded around as well, and subsequently exist embedded in the plastic. At one end, these electrical contact elements end as exposed contact pins 57 of electrical attachment plug 56, which can be connected to a corresponding electrical connector element (not shown), such as a terminal strip, for full electrical contacting of the injector. At the end facing opposite of attachment plug 56, the contact elements run down to the lower end face 58 of connecting part 40, forming an electrical connecting elements 59 there, which is executed, for example, as likewise exposed contact pins. In the completely assembled fuel injector, connecting elements 34 and 59 cooperate in such a manner that a reliable electrical connection is formed, contact pins 59 meshing with, for example, the bushing-like, eye-like, clamp-like, pin-shaped, or cable-lug shaped connecting elements 34 at functional part 30. Thus, the electrical contacting of magnetic coil 1, and consequently its excitation, is carried out via electrical attachment plug 56 and via the electrical interconnection region 34, 59.

Figure 4:
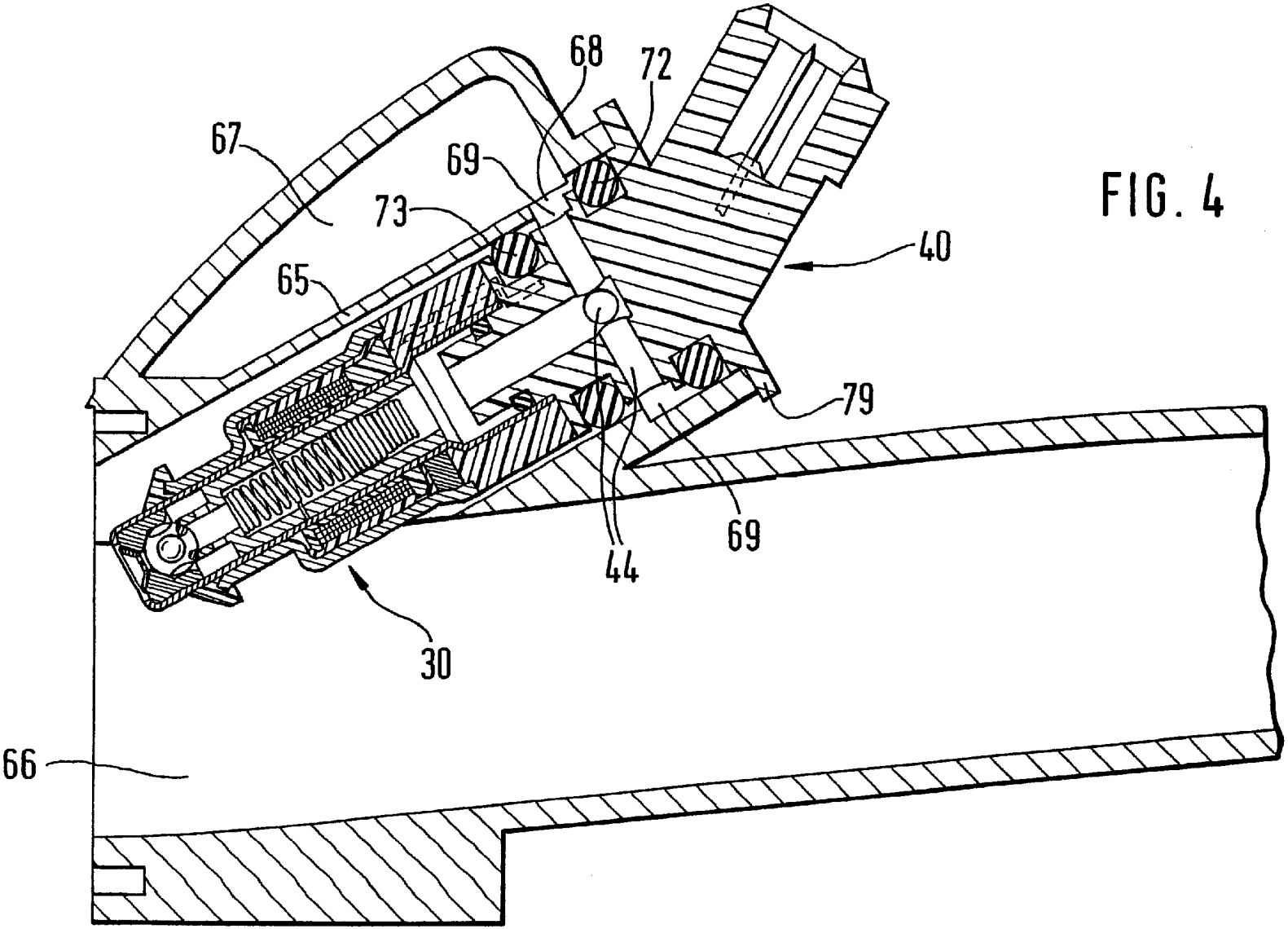
FIG. 4 shows the injector according to FIG. 1 mounted in a receiving socket of an induction pipe of an internal combustion engine.
Figure 5:
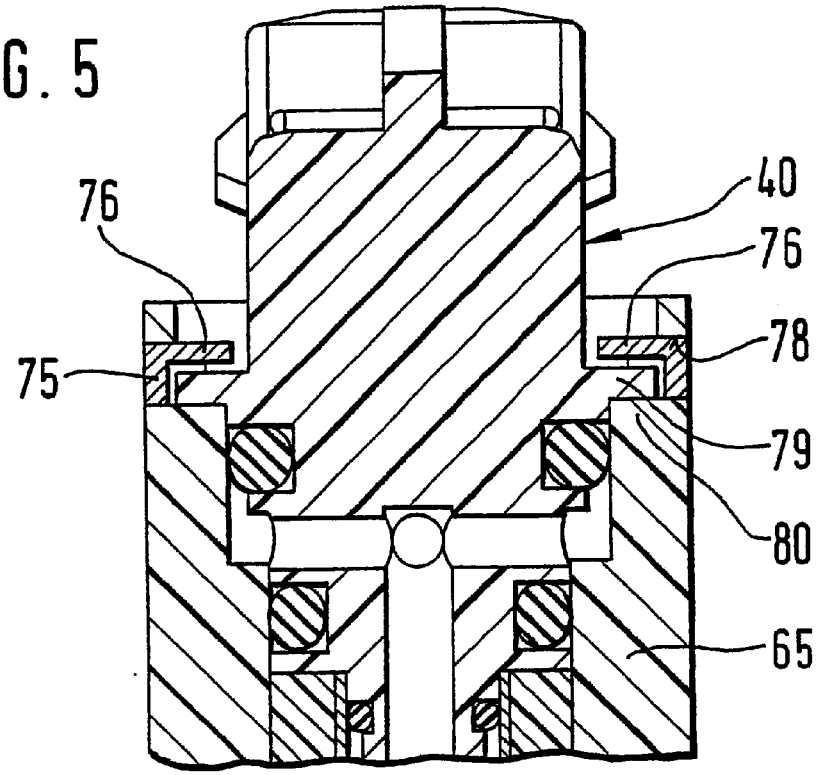
FIG. 5 shows a first exemplary embodiment of a fastening of a fuel injector to a receiving socket.
Figure 6:
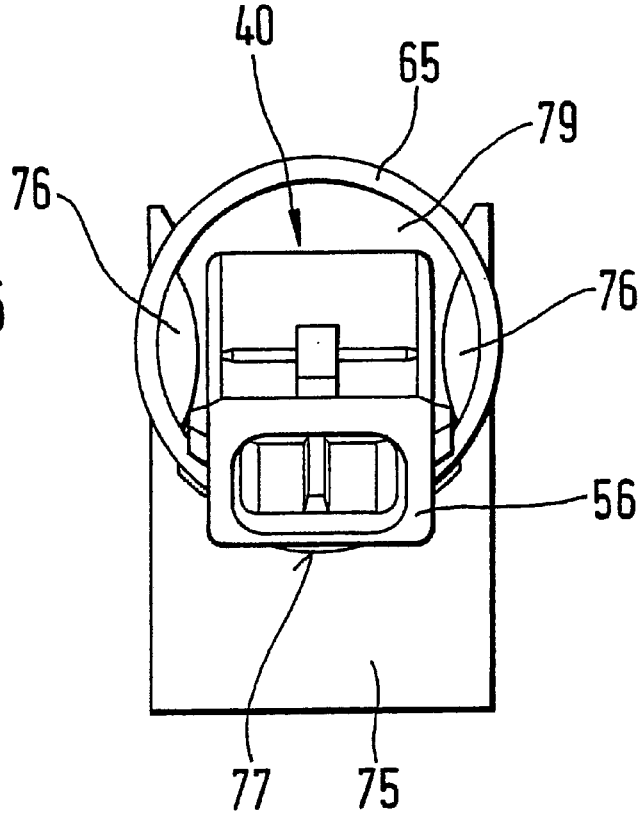
FIG. 6 shows a top view of the valve partially shown in FIG. 5.

Thus, connecting part 40 is formed in such a way that electrical attachment plug 56 is located farther away from functional part 30 than the fuel entry region into the injector at radial boreholes 44. Thus, a particularly slender and compact valve exists, which, inside a receiving socket 65, can be laterally supplied with fuel very easily (FIG. 4). Attachment plug 56 has, for example, a buckled design with respect to valve longitudinal axis 10.

Figure 3:
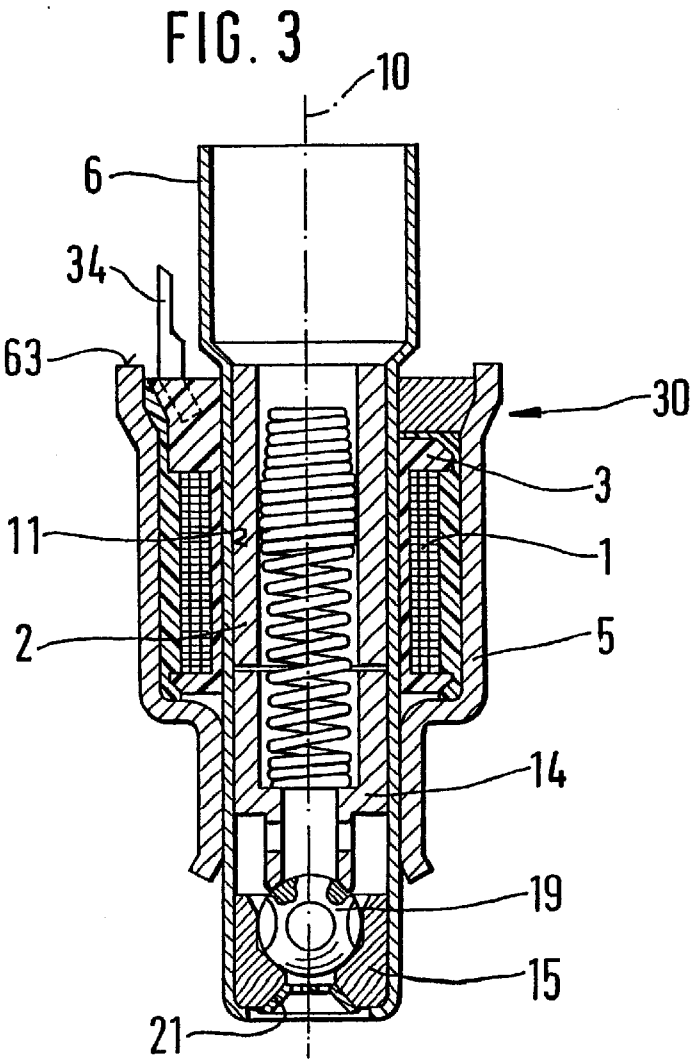
FIG. 3 shows a functional part of the valve according to FIG. 1, the functional part constituting the second subassembly.
Figure 2:
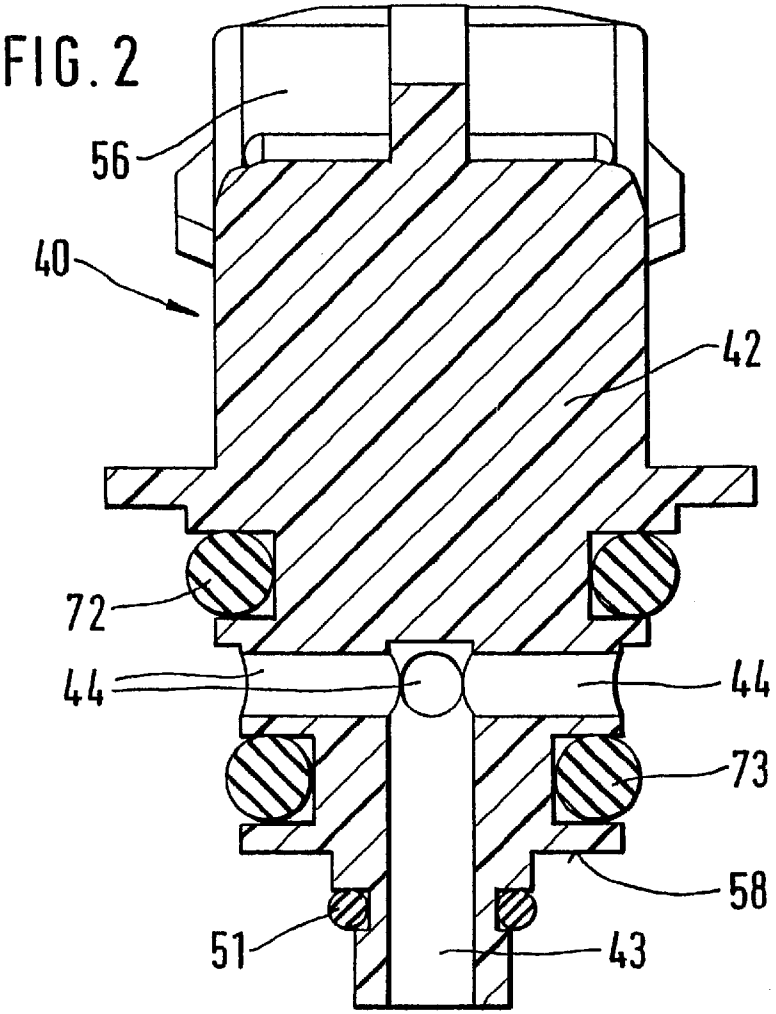
FIG. 2 shows a connecting part of the valve according to FIG. 1, the connecting part constituting the first subassembly, and the section through connecting part being led such that it is rotated by 90° compared to FIG. 1.

FIGS. 2 and 3 show the two independent and already preassembled subassemblies, functional part 30 and connecting part 40, prior to the final assembly of the fuel injector.

After the corresponding preassembly, these two subassemblies, functional part 30 and connecting part 40, are fixedly joined in a last process step. To this end, connecting part 40 is inserted into opening 11 of valve sleeve 6 in functional part 30 so far until end face 58 strikes against, for example, valve sleeve 6, by which the hydraulic connection of both subassemblies 30, 40, with the assistance of the corresponding sealing at valve sleeve 6 by sealing ring 51, is already achieved. In the process, both subassemblies 30, 40 are electrically connected as well, since electrical connecting elements 34 and 59 of both sides mesh with each other (FIG. 1).

After that, preassembled subassemblies 30, 40 are, for example, injection-molded around in the interconnection region to mechanically connect both subassemblies 30, 40. In this context, the volume between lower end face 58 of connecting part 40 and cover element 33 of functional part 30 is filled with plastic annularly at the outer circumference of valve sleeve 6 up to the outer circumference of base member 42 and of valve jacket 5, respectively, so that a flush closure is formed toward the outside (FIG. 1). With the assistance of this injection molding 60, electrical connecting elements 34, 59 are securely protected from the influences of the engine compartment (dirt, fuel). The quality of the connection between injection molding 60 made of plastic and metallic functional part 30 can be improved in that, for example, a plurality of grooves are turned or rolled in at the upper end 63 of valve jacket 5 facing connecting part 40. Instead of an injection molding 60, it is also possible to use jointing methods such as bonding, ultrasonic welding, or crimping to produce the fixed connection of the two subassemblies 30, 40.

FIG. 4 shows a mounting variant for a fuel injector according to the present invention in accordance with FIGS. 1 through 3 in a receiving socket 65 of an induction pipe 66 of an internal combustion engine. The spray-side end of the fuel injector advantageously protrudes into the interior of induction pipe 66 so that one can spray in a really well-directed manner toward an intake valve (not shown), without producing major wall wettings in induction pipe 66. Integrally injection-molded at receiving socket 65 or several receiving sockets 65 lying one behind the other is a transversely running supply duct 67, which supplies one or several fuel injectors with fuel. The design of the fuel injectors as so-called "side-feed injectors" has the advantage of a lateral integration of supply duct 67 at induction pipe 66 or immediately at the cylinder head so that additional fuel distributors can be dispensed with. In the region of each fuel injector, the wall of receiving socket 65 is provided with an opening region 68, which can be designed in the form of a groove or a bore hole, and which allows the fuel to flow into the interior of receiving socket 65. Provided in receiving socket 65 is an annular inlet region 69 from which radial boreholes 44 in connecting part 40 are immediately supplied. Two sealing rings 72 and 73 at the outer circumference of connecting part 40 provide a sealing of the fuel injector with respect to the wall of receiving socket 65.

FIGS. 5 through 10 show three exemplary embodiments for fastenings or axial fixings and anti-rotation protection of a fuel injector at a receiving socket 65. A first variant (FIGS. 5 and 6) provides that the fuel injector is fastened to receiving socket 65 with the assistance of a clamping element 75 which is formed, for example, in the shape of a disk and has two fixing claws 76. For the engagement of clamping element 75, for example, a groove 77 is formed at the outer circumference of receiving socket 65, the groove being interrupted at two locations so that two openings 78 are present through which curved fixing claws 76 can penetrate. Connecting part 40, via an outwardly annularly projecting shoulder 79, rests on an upper end (FIG. 4) or an offset 80 of the wall (FIG. 5) of receiving socket 65.

Figure 7:
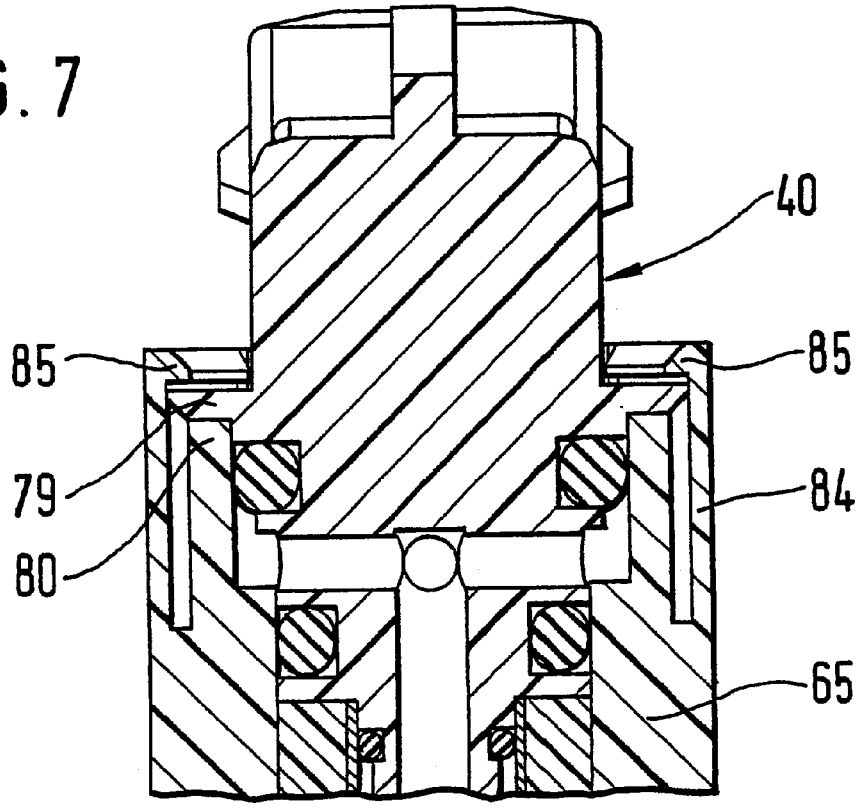
FIG. 7 shows a second exemplary embodiment of a fastening of a fuel injector to a receiving socket.
Figure 8:
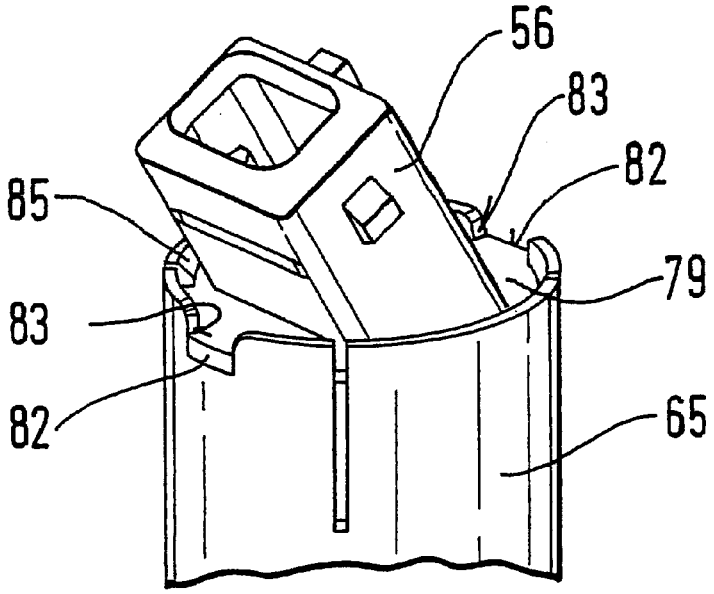
FIG. 8 shows a lateral view of the valve partially shown in FIG. 7.

In the exemplary embodiment according to FIGS. 7 and 8, no additional fixing element is provided. Fixing elements are rather provided immediately on the fuel injector or receiving socket 65, respectively. Again, shoulder 79 of connecting part 40 rests on an offset 80 of receiving socket 65, however, for example, two fixing noses 82 distributed over the circumference and originating from outwardly radially extending shoulder 79, the fixing noses engaging with openings 83 of receiving socket 65. By this engagement the fuel injector is protected against rotation. Openings 83 are arranged in an outer annular region 84 of receiving socket 65, the annular region encircling shoulder 79. At, for example, two mutually opposing locations in terms of circumference, annular region 84 ends in each case with a locking hook 85 above shoulder 79, the locking hooks, by lapping over, preventing the valve from axially slipping with respect to receiving socket 65.

Figure 9:
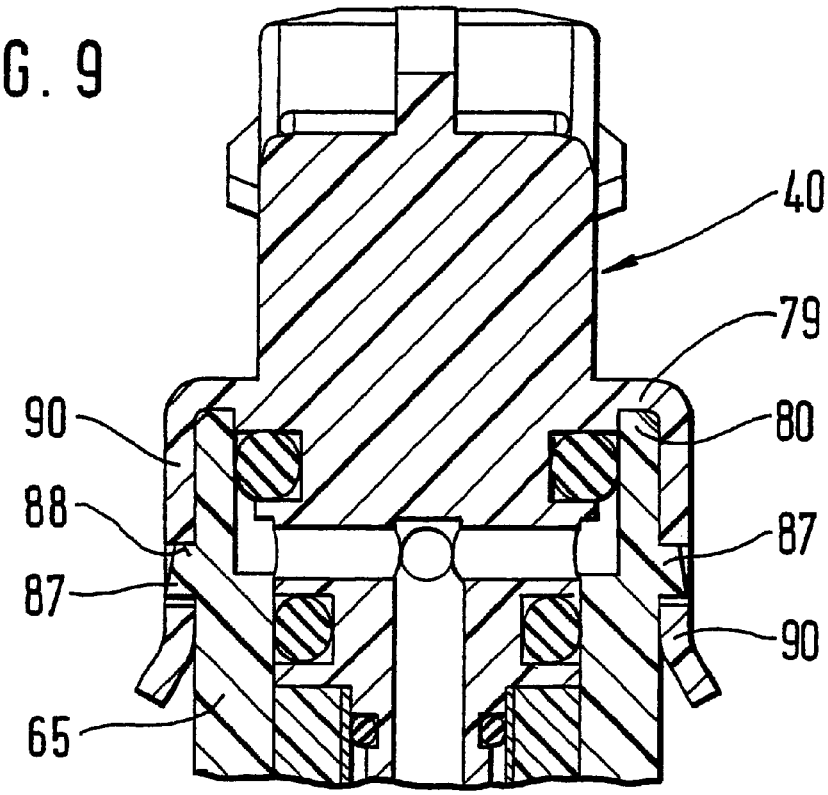
FIG. 9 shows a third exemplary embodiment of a fastening of a fuel injector to a receiving socket.
Figure 10:
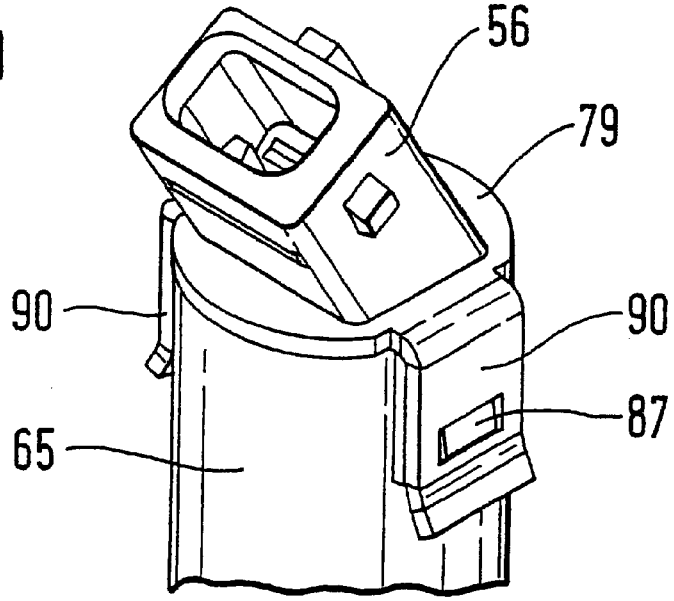
FIG. 10 shows a lateral view of the valve partially shown in FIG. 9.

FIGS. 9 and 10 show a fastening variant which stands out in that, for example, two outwardly projecting fixing noses 87 are integrally formed on the outer circumference of receiving socket 65. Provided as elements corresponding to fixing noses 87 are receiving openings 88, in which fixing noses 87 snap in, whereby the fuel injector is protected against rotation and is axially fixed in position. Receiving openings 88 are arranged in two fixing straps 90 of connecting part 40, which originate at shoulder 79, and extend axially along the outer circumference of receiving socket 65.

These detachable interconnection regions of FIGS. 5 through 10 are depicted only exemplarily and in a simplified manner (for example, without contact pins 57). A plurality of other ways of fastening are equally conceivable such as via bayonet catch. In particular, detent and snap connections would provide a solution.

All described exemplary embodiments of the fuel injectors have the advantage of an inexpensive producibility, including a great number of design variants. Functional parts 30 which are manufactured in great quantities, largely of the same design can be connected to a great number of different connecting parts 40 differing, for example, in the size, in the form of electric attachment plug 56, etc. Thus, the logistics during the manufacture of fuel injectors is fundamentally simplified.

What is claimed is:

1. A fuel injector for a fuel-injection system of an internal combustion engine, comprising:

a preassembled functional part including:

an excitable actuating element, a sealing valve including a valve seat body and a movable valve closure member, a valve-seat face allocated to the valve seat body, wherein the valve closure member cooperates with the valve-seat face, first electrical connecting elements, and first hydraulic connecting elements; and a preassembled connecting part fixedly interconnected with the preassembled functional part and forming with the preassembled functional part a plurality of independent subassemblies, the preassembled connecting part including:

an electrical connection, a hydraulic connection, second electrical connecting elements, and second hydraulic connecting elements, wherein the electrical connection is located farther away from the preassembled functional part than the hydraulic connection, and wherein a reliable electrical connection and a reliable hydraulic connection of the subassemblies are ensured by a cooperation between the first electrical connecting elements and the second electrical connecting elements and between the first hydraulic connecting elements and the second hydraulic connecting elements.

2. The fuel injector according to claim 1, wherein:

the preassembled connecting part includes a substantially plastic body forming a base member having at least one radial borehole and a subsequent flow, and an electrical attachment plug is formed on the base member on a side of the at least one radial borehole facing away from the preassembled functional part.

3. The fuel injector according to claim 2, wherein:

the electrical attachment plug is formed according to a buckled design relative to a valve longitudinal axis.

4. The fuel injector according to claim 1, wherein:

the preassembled functional part and the preassembled connecting part are fixedly interconnected in an interconnection region by a plastic injection molding technique.

5. The fuel injector according to claim 1, further comprising:

a valve needle;

a core;

a magnetic coil; and a valve jacket, wherein:

the preassembled functional part includes a thin-walled valve sleeve provided with an internal opening accommodating the valve-seat body, the valve needle, and a core as an internal pole, the thin-walled sleeve is surrounded by the magnetic coil, and the magnetic coil is encircled at least partially by the valve jacket as an external pole.

6. The fuel injector according to claim 5, wherein:

the thin-walled valve sleeve encloses an end region of the preassembled connecting part, the end region protruding into the internal opening.

7. The fuel injector according to claim 6, further comprising:

a sealing ring arranged at the end region of the preassembled connecting part.

8. The fuel injector according to claim 1, wherein:

a design of the first electrical connecting elements and the second electrical connecting elements corresponds to that of at least one of a plug and a bushing.

9. The fuel injector according to claim 1, wherein:

the preassembled connecting part includes an outwardly radially projecting shoulder capable of being placed on an offset of a receiving socket.

10. The fuel injector according to claim 1, further comprising:

at least one fixing element arranged at the preassembled connecting part, the at least one fixing element cooperating with a corresponding fixing element of a receiving socket used for receiving the fuel injector.

11. The fuel injector according to claim 10, wherein:

the at least one fixing element of the preassembled connecting part is formed as a fixing nose.

12. The fuel injector according to claim 10, wherein:

the at least one fixing element of the preassembled connecting part is formed as a receiving opening.

13. The fuel injector according to claim 1, wherein:

a clamping element engages on the preassembled connecting part to achieve a fastening.

* * * * *